US007398891B2

(12) United States Patent
Yang

(10) Patent No.: US 7,398,891 B2
(45) Date of Patent: Jul. 15, 2008

(54) COVER STRUCTURE FOR WATER BAG INLET

(76) Inventor: Shih-Sheng Yang, Wu Kung Er Rd., Hsin Chuang City, Taipei Hsien (TW)

( * ) Notice: Subject to any disclaimer, the term of this patent is extended or adjusted under 35 U.S.C. 154(b) by 169 days.

(21) Appl. No.: 10/843,474

(22) Filed: May 12, 2004

(65) Prior Publication Data

US 2005/0254734 A1 Nov. 17, 2005

(51) Int. Cl.

| | |
|---|---|
| ***B65D 25/28*** | (2006.01) |
| ***B65D 55/16*** | (2006.01) |
| ***B65D 41/04*** | (2006.01) |
| ***B65D 45/32*** | (2006.01) |
| ***B65D 51/18*** | (2006.01) |
| *B65D 23/10* | (2006.01) |
| *A45F 3/04* | (2006.01) |

(52) U.S. Cl. ..... 220/212.5; 215/306; 215/396; 220/288; 220/319; 220/375; 220/254.8; 224/148.4; 224/148.5; 383/66; 383/80

(58) Field of Classification Search ..... 383/6, 383/13, 16, 26, 66, 80, 901; 220/375, 319, 220/745–758, 327, 288, 304, 768, 212.5, 220/321, 254.8; 215/396, 283, 274, 276, 215/306, 399, 6; 224/148.7, 148.5, 153, 224/148.4, 148.1; 16/DIG. 24, DIG. 25, 16/DIG. 40, 422, 425; 222/175, 469, 466, 222/475, 465.1, 543

See application file for complete search history.

(56) References Cited

U.S. PATENT DOCUMENTS

| | | | | |
|---|---|---|---|---|
| 1,859,614 | A * | 5/1932 | Boever | 215/396 |
| 3,120,974 | A * | 2/1964 | Matson | 294/31.2 |
| 3,275,366 | A * | 9/1966 | Hidding | 294/31.2 |
| 4,457,445 | A * | 7/1984 | Hanks et al. | 220/214 |
| 4,768,403 | A * | 9/1988 | Bar-Noy | 81/3.15 |
| 4,828,300 | A * | 5/1989 | Agbay | 292/256.6 |
| 5,662,629 | A * | 9/1997 | Steer et al. | 604/342 |
| 5,830,200 | A * | 11/1998 | Steer et al. | 604/338 |
| 5,890,635 | A * | 4/1999 | Wu et al. | 224/148.4 |
| 5,954,213 | A * | 9/1999 | Gerhart et al. | 215/10 |
| 6,179,146 | B1 * | 1/2001 | Betras | 220/23.4 |
| 6,675,998 | B2 * | 1/2004 | Forsman et al. | 224/148.2 |
| 6,837,472 | B1 * | 1/2005 | Beutz | 248/312 |
| 7,014,077 | B2 * | 3/2006 | Brown | 222/543 |
| 2004/0211778 | A1 * | 10/2004 | Lien | 220/212.5 |
| 2004/0217117 | A1 * | 11/2004 | Lien | 220/375 |

* cited by examiner

*Primary Examiner*—Robin Hylton
(74) *Attorney, Agent, or Firm*—Leong C. Lei

(57) ABSTRACT

A cover structure for a water bag inlet comprises: a base, a locking for mounting at the outer periphery of the base, and a cover for mounting on the base. An extension and a locking rim are respectively provided at two ends of the base. A groove is formed at the periphery of the base and is provided with locking blocks at an appropriate position. The locking ring is provided with locking sockets for combining with the locking blocks, and an opening at a pre-determined position of the inner rim of the locking ring, while a fastener is provided at respective ends and can be mounted with a cap, which has a switch at one end surface. Accordingly, the cover can be firmly combined with the base or freely detached to alter its assembly.

2 Claims, 8 Drawing Sheets

COVER STRUCTURE FOR WATER BAG INLET

BACKGROUND OF THE INVENTION (a) Technical Field of the Invention

The present invention relates to a cover structure for a water bag inlet, particularly to one that can allow film combination of a cover and a base, such that the cover can be freely detached to alter assembly and that the water bag containing with liquid can be hold or installed at a back pack conveniently.

(b) Description of the Prior Art

Cycling has become a popular leisure and sporting activity. To solve the issue of water supply during cycling, bicyclists used to prepare water or a sports drink contained in a bottle and put in the rack of the bicycle. However, when the bicyclist wanted to take the water bottle, he/she had to bend to reach it by hand, which exists inconvenience and danger and therefore requires improvements.

In view of the fact that the cyclist has difficulty and frustration in obtaining the water bottle, the relevant businessmen have researched and developed a water bag, which allows the cyclists to carry it on the back and drink the water contained therein via an extending water conduit that is combined with a nozzle at one end. The cyclists can hold the nozzle in the mouth and bite down to open the crevice of the nozzle to directly drink water from the water bag without bending to reach it. Although the aforesaid water bag structure has improved the disadvantages existing in the prior art, when washing the water bag, the inlet thereof is not big enough, rendering the user unable to insert his/her hand into the water for washing purposes. Additionally, the inside of the water bag can easily become dirty and cannot be completely cleaned. Also, as the water bag structure of the prior art is made of soft material, it is not convenient for the user to grip. As there still exist disadvantages in the water bag of the prior art, it requires further improvements.

The water bag of the prior is put into a backpack after replenished with water or drink and supplies water to the user via a water conduit. If the user needs to replenish the bag with water, he/she has to take off the backpack and get out the water bag. Since such use status is quite inconvenient, U.S. Publication No. 2002/0014498 A1 has disclosed a "Hydration System for Liquid Reservoir", the cover of which includes a supporting element to extend around the neck of the opening of a filling path for supporting said neck, such that liquid can be directly poured into water bag through the opening. However, as it is hard to detach the supporting element from the water bag, the lay consumers cannot operate the structure easily.

SUMMARY OF THE INVENTION

The primary object of the invention is to provide a structure for a water bag inlet, which can allow firm combination of the cover to the base and free detachment thereof for alteration in assembly, such that the user can conveniently grip the water bag and easily detach the water bag from the backpack.

To obtain the above object, the invention discloses a cover structure for a water bag inlet comprises: a base, a locking for mounting at the outer periphery of the base, and a cover for mounting on the base. A hole is provided at the center of the base, which is provided an extension and a locking rim at respective two ends. A groove is formed at the periphery of the base and is provided with locking blocks at an appropriate position. The locking ring is provided with locking sockets for combining with the locking blocks, and an opening at a pre-determined position of the inner rim of the locking ring, while a fastener is provided at respective ends and can be mounted with a cap, which is for mounting on the hole of the base and has a switch at one end surface. Accordingly, the cover can be firmly combined with the base or freely detached to alter its assembly.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
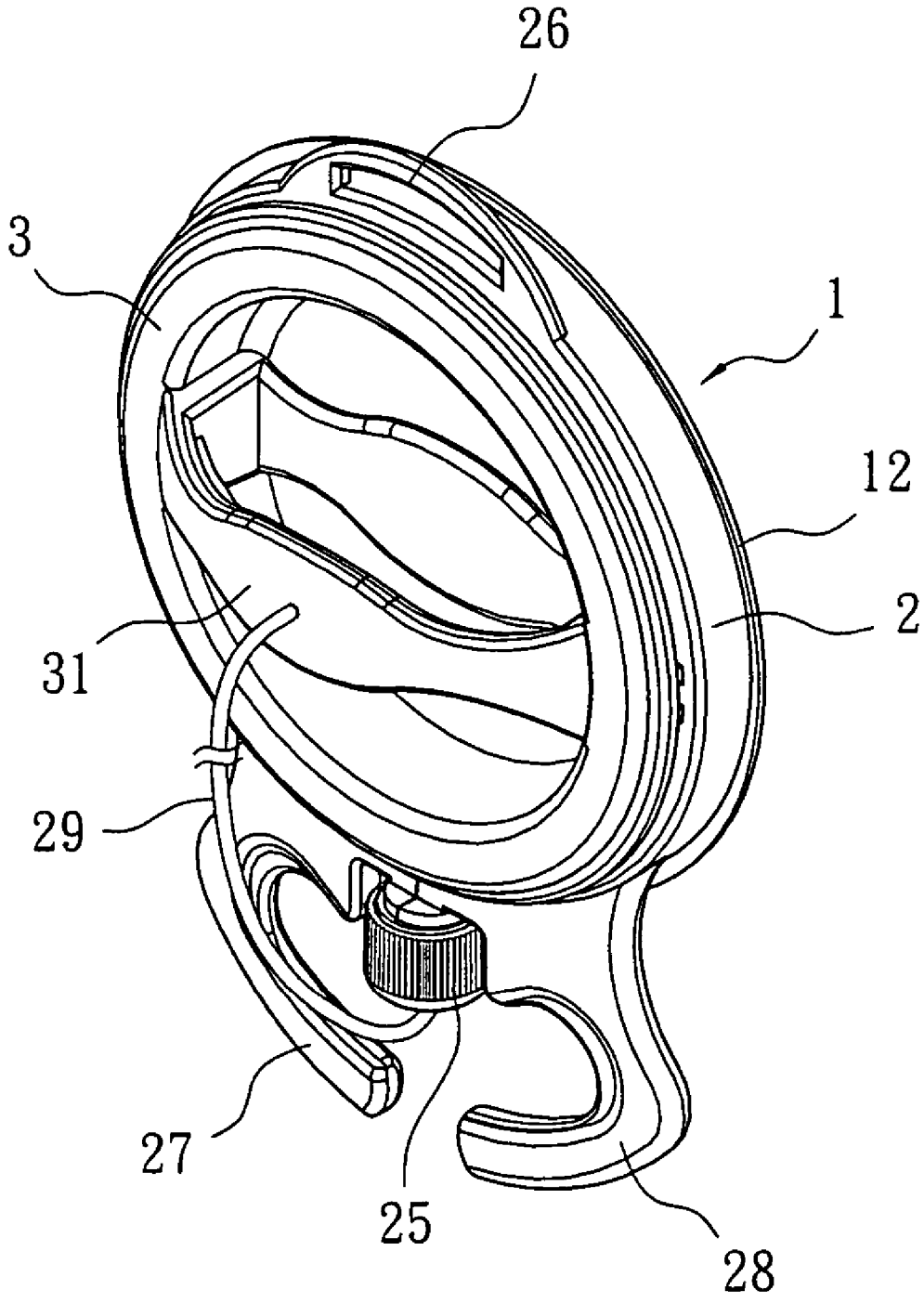
FIG. 1 is a perspective view of the present invention.
Figure 2:
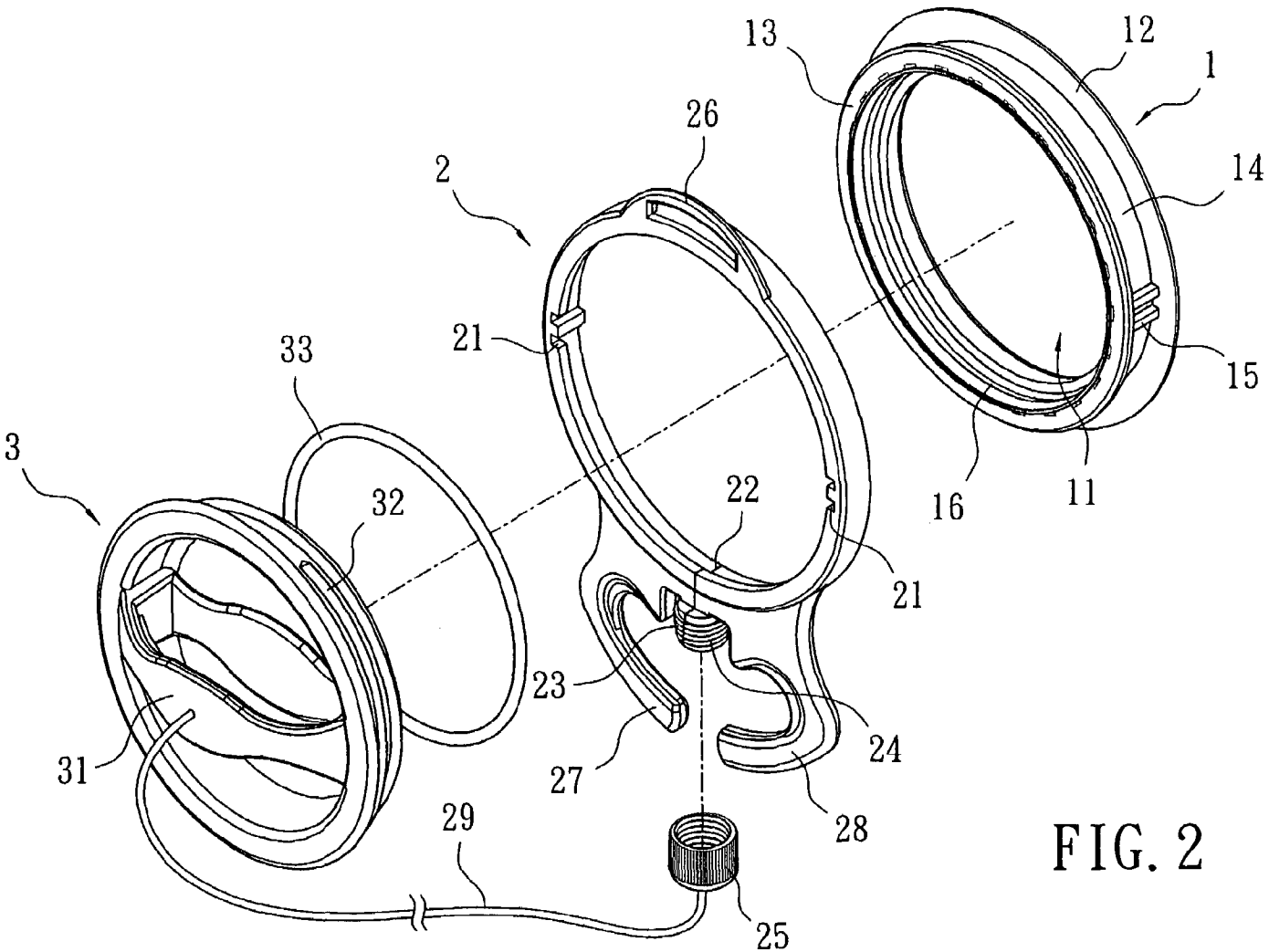
FIG. 2 is an exploded view of the present invention.
Figure 3:
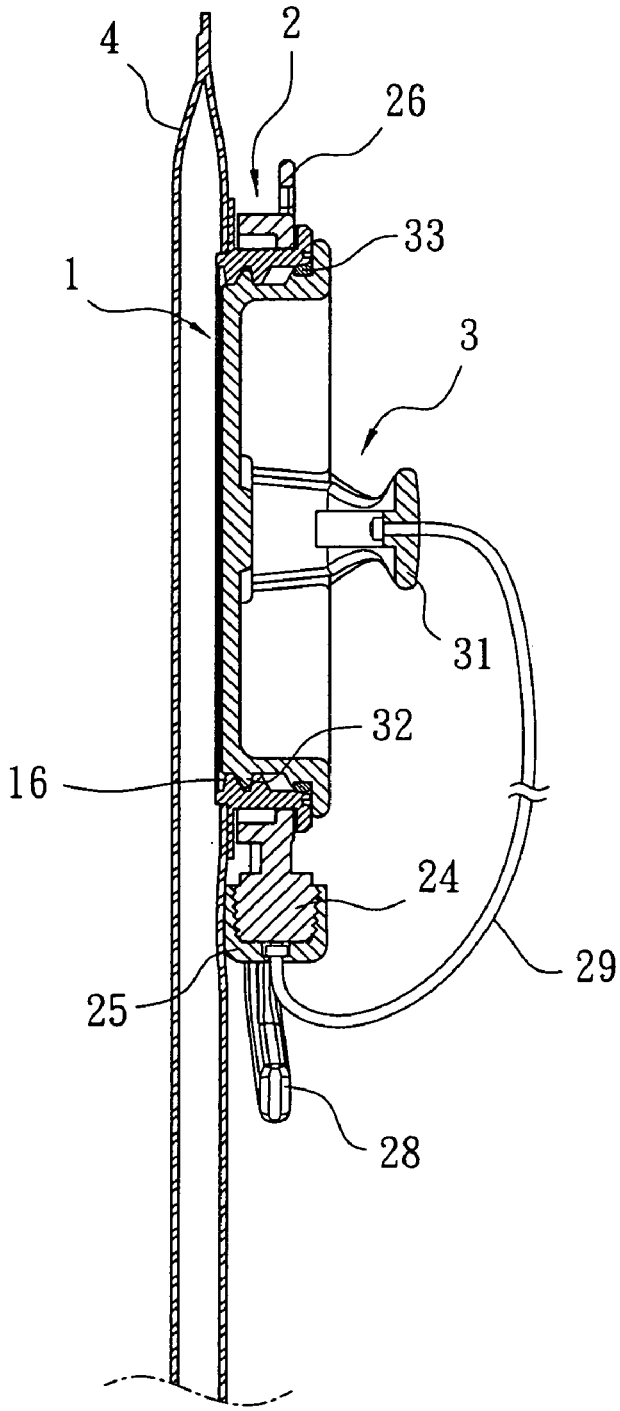
FIG. 3 is cut-away view showing the combination of the invention to a water bag.
Figure 4:
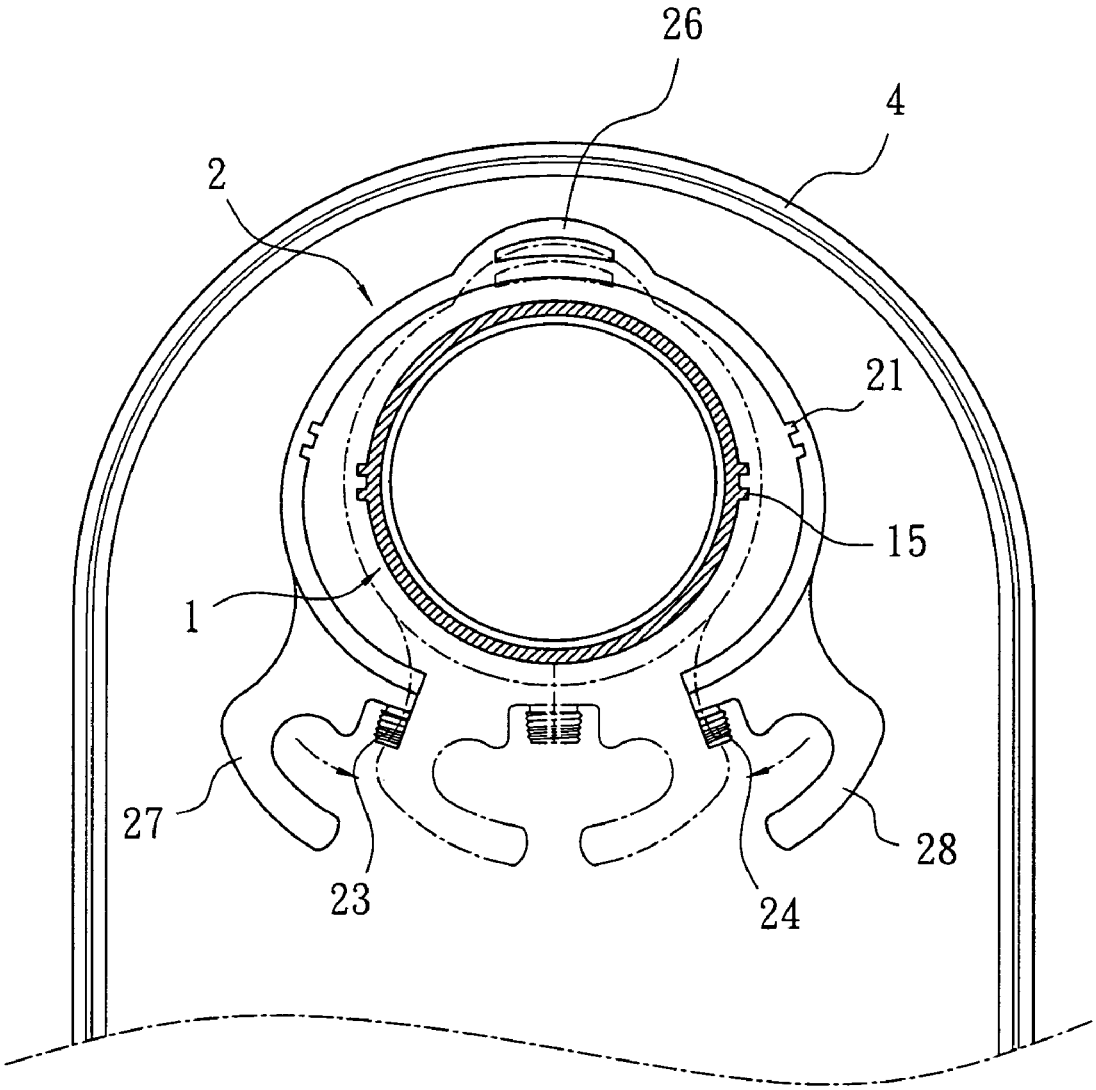
FIG. 4 shows the use status of the locking ring according to the invention.
Figure 5:
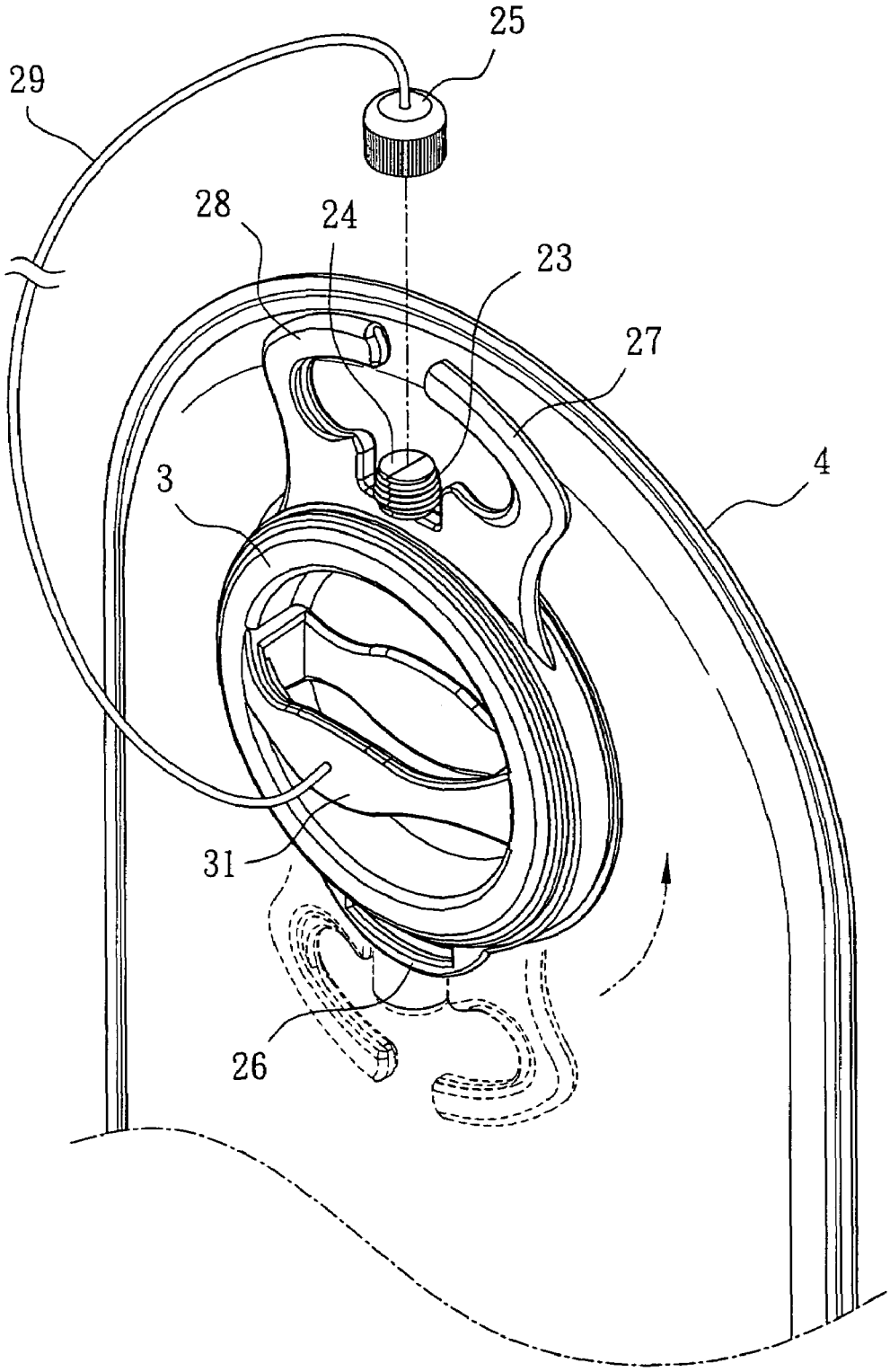
FIG. 5 shows the alteration of the position of the locking ring.
Figure 6:
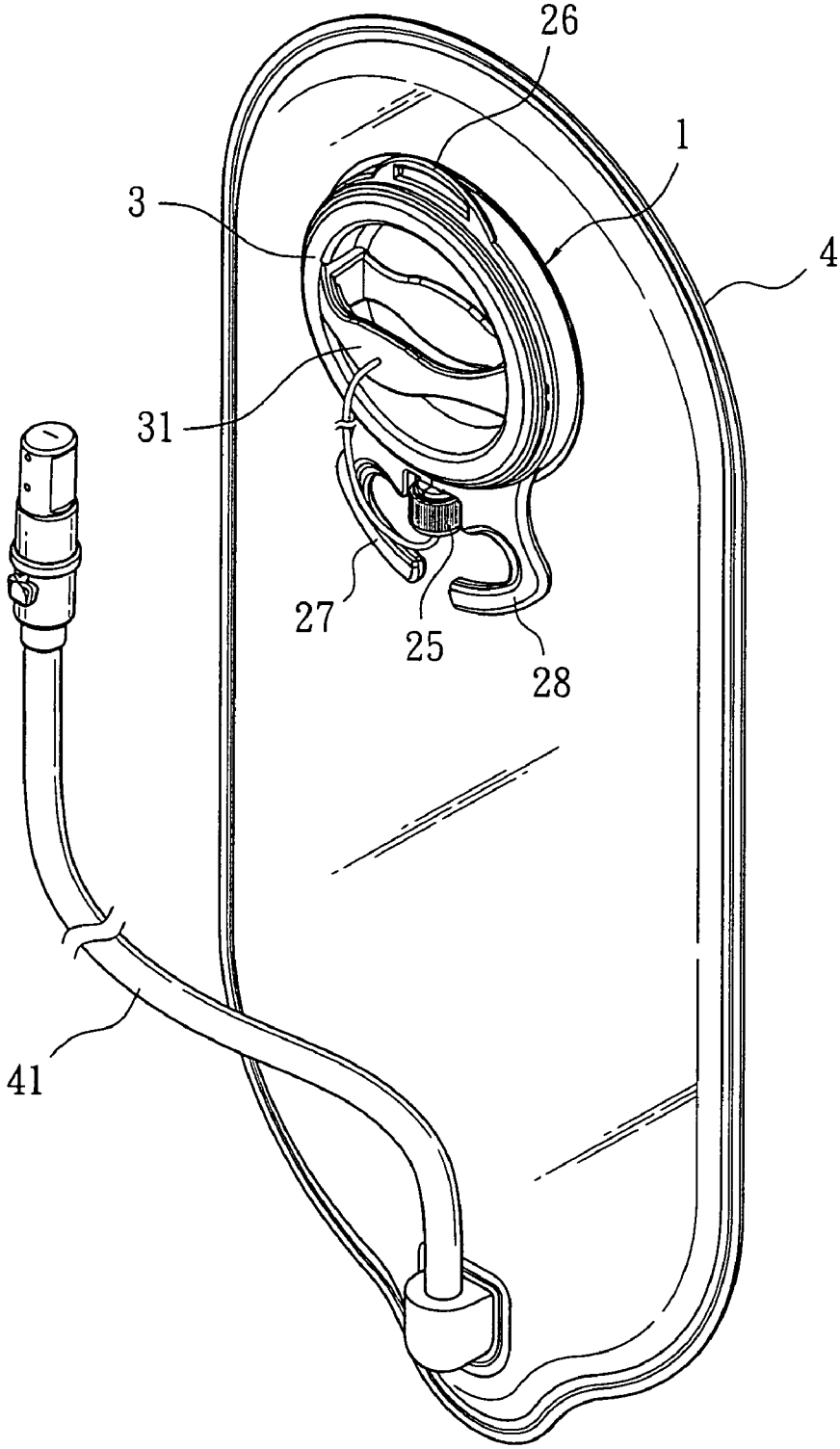
FIG. 6 is a perspective view showing the combination of the invention to a water bag.
Figure 7:
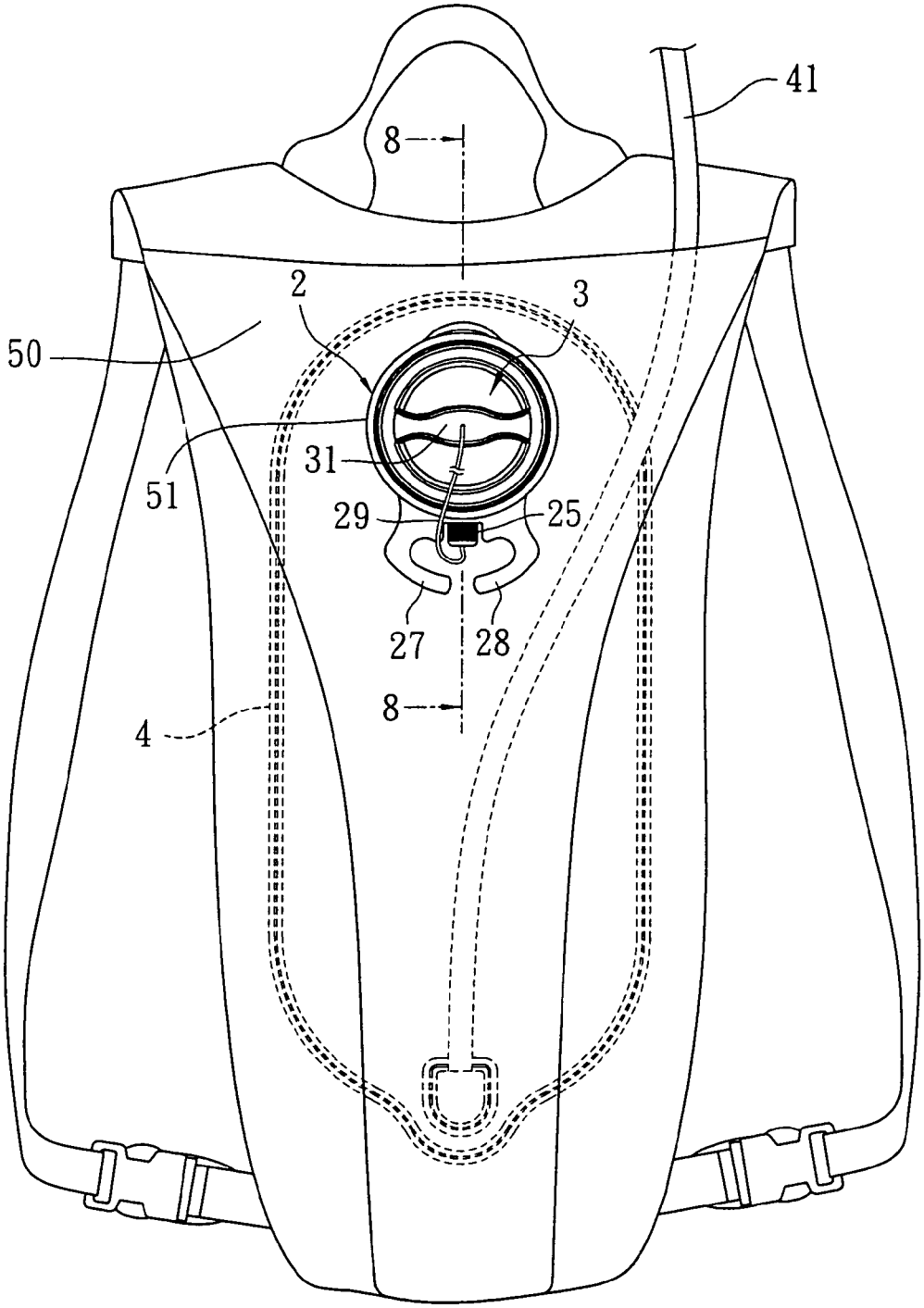
FIG. 7 is a perspective view showing the combination of the invention to a backpack.

As shown in FIGS. 1 to 3, the invention relates to a cover structure for a water bag inlet, which is composed of a base 1, a locking ring 2 and a cover 3. The cover 3 can be firmly combined to the base 1 such that the cover 3 can be freely detached to alter assembly and that the user can grip the water bag 4 conveniently (as shown in FIG. 4) or connected to a backpack (as shown in FIG. 7) for alternative use.

A hole 11 is provided at the center of the base 1, which is provided an extension 12 for combining to the body of a water bag 4 (as shown in FIG. 3), and a locking rim 13 at two ends, respectively. Accordingly, the periphery of the base 1 forms a groove 14 between the extension 12 and the locking rim 13. The groove 14 is provided with locking blocks 15 at an appropriate position. The inner rim of the hole 11 of the base 1 is provided with interior threads 16 for screwing with the cover 3.

The locking ring 2 can be mounted on the groove 14 of the base 1, and is provided with locking sockets 21 for combining with the locking blocks 15. An opening 22 is provided at a pre-determined position of the locking ring 2, while a fastener (23, 24) is provided at respective ends of the opening 22. The outer surface of the fasteners 23,24 is provided with exterior threads for screwing with a cap 25. While the fasteners 23, 24 can be combined with the cap 25 via exterior threads and interior threads, a string 29 is tied between the cap 25 and a switch 31 to prevent the cap 25 from lost after being detached from the fasteners 23, 24. Besides, the locking ring 2 is provided with a hanger 26; and a handle (27, 28) is respectively provided at the outer sides of the fasteners 23,24 of the locking ring 2.

The cover 3 is mounted on the center of the hole 11 and is provided with an upwardly extruding board 31 to make it easier for the user to open the cover 3. The user can use his/her fingers to turn the upwardly extruding board 31 to rotate the cover 3. In addition, the outer rim of the cover 3 is provided with exterior threads 32 for screwing to the interior threads 16 of the hole 11 of the base 1. An O-ring 33 is mounted at the terminal end of the route of the exterior threads 32 on the cover 3 (as shown in FIG. 3), such that when the cover 3 is screwed to the terminal end of the interior threads 16 of the base 1, the cover 3 will press the O-ring 33 to keep the water from leaking out of the water bag 4 from the hole 11 of the base 1. Accordingly, the above structure will constitute a novel cover structure for a water bag inlet.

Referring to FIGS. 2 to 6, when the invention is in use, the locking ring 2 can be freely detached by screwing off the cap 25, pulling open the handles 27, 28 at the outer side of the fasteners 23, 24, departing the locking sockets 21 at the inner rim of the locking ring 24 from the locking blocks 15 at the groove 14 of the base 1, and making the opening formed by the fasteners 23, 24 present an wide open status, thereby the locking ring 2 will be detached from the base 1. Accordingly, the user can easily remove the locking 2 from the upside of the water bag 4 to the underside of the water bag 4.

Figure 8:
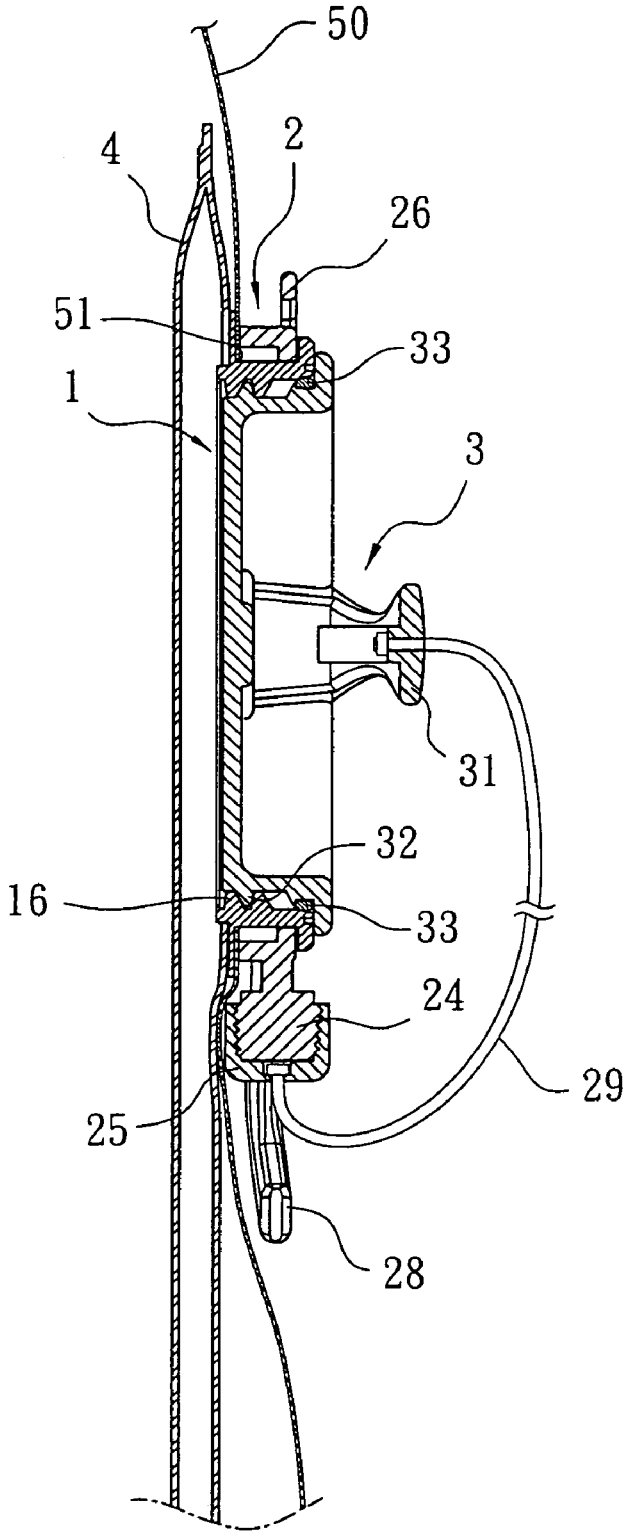
FIG. 8 is cut-away view taken from FIG. 7.

Referring to FIGS. 2, 7 and 8, when the user intends to put the water bag 4 infused with liquid into a backpack 50, he/she can firstly detach the locking ring 2 to allow the locking rim 13 and groove 14 of the base 1 exposed out of the backpack 50 through an opening 51 on the backpack 50, and then mounting the locking ring 2 on the groove 14, such that the frame of the locking ring 2 will press on the periphery of the opening 51 of the backpack 50, and firmly screwing the cap 25 to the fasteners 23, 24. Furthermore, when the water bag 4 is taken away from the backpack 50, the hanger 26 can be used to hang the water bag 4 on the wall. Alternatively, when the water bag 4 is put into the backpack 50, the use can insert a patch prepared inside of the backpack 50 through the hanger 26 to hold water bag 4 and refrain it from falling to the bottom of the backpack 50. The user can drink the liquid from the water bag 4 via the nozzle at the end of the water conduit 41 exposed outside of the backpack 50.

In conclusion, the cover structure for a water bag inlet according to the present invention can allow firm combination of the cover and the base. The cover can be easily operated to alter the assembly. As such, the invention has greatly improved the disadvantages existing in the prior art and therefore is novel, much more practical and applicable for use, as claimed by the inventor.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cover structure for a water bag inlet, comprising:

a base having a center provided with a hole, an extension extending outwardly from a periphery of said base, a locking rim extending outwardly from an opposite periphery of said base, thereby forming a groove between said extension and said locking rim, said groove being provided with locking blocks;

a locking ring mounted in said groove of said base, said locking ring having an inner rim provided with locking sockets each for combining with a respective one of said locking blocks, said locking ring being provided at a pre-determined position with an opening, two threaded fasteners being each provided at a respective end of said opening, said locking ring being provided with a hanger;

a cap threadedly engaged with said fasteners to keep said opening closed;

a cover provided for mounting on said hole of said base and having an outer side provided with an upwardly protruding board for a user to turn the cover; and a handle is provided at respective two sides of the fasteners of the locking ring.

2. The cover structure for a water bag inlet according to claim 1, wherein said outer side of said cover is connected with an end of a string and another end of said string is connected with said cap.

* * * * *